US006924022B2

(12) United States Patent
Dischler et al.

(10) Patent No.: US 6,924,022 B2
(45) **Date of Patent: *Aug. 2, 2005**

(54) DESIRABLE HAND FABRICS EXHIBITING LOW FILL TENSILE STRENGTH LOSS AFTER PHYSICAL TREATMENTS

(75) Inventors: Louis Dischler, Spartanurg, SC (US); Jimmy B. Henson, Pacolet Mills, SC (US); Roger Milliken, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/873,475

(22) Filed: Jun. 4, 2001

(65) Prior Publication Data

US 2002/0019186 A1 Feb. 14, 2002

Related U.S. Application Data

(63) Continuation of application No. 09/777,444, filed on Feb. 6, 2001, which is a continuation of application No. 09/569,473, filed on May 12, 2000, now Pat. No. 6,230,376, which is a continuation of application No. 09/252,513, filed on Feb. 18, 1999, now Pat. No. 6,112,381.

(51) Int. Cl.[7] ..... D06C 11/00; B32B 5/08; B32B 33/00

(52) U.S. Cl. ..... 428/91; 428/97; 442/217; 442/220; 26/28

(58) Field of Search ..... 428/85, 91, 97; 442/217, 220; 139/420 R, 420 A; 26/28

(56) References Cited

U.S. PATENT DOCUMENTS

| | | | | | |
|---|---|---|---|---|---|
| 4,468,844 | A | * | 9/1984 | Otto | 26/28 |
| 5,080,952 | A | * | 1/1992 | Willbanks | 428/91 |
| 6,112,381 | A | * | 9/2000 | Dischler et al. | 26/28 |
| 6,230,376 | B1 | * | 5/2001 | Dischler et al. | 26/28 |
| 6,260,247 | B1 | * | 7/2001 | Dischler et al. | 26/28 |
| 6,269,525 | B2 | * | 8/2001 | Dischler et al. | 26/28 |

* cited by examiner

*Primary Examiner*—Cheryl A. Juska
*Assistant Examiner*—Jenna-Leigh Befumo
(74) *Attorney, Agent, or Firm*—Terry T. Moyer

(57) ABSTRACT

The inventive method provides highly desirable hand to various different types of fabrics through the initial immobilization of individual fibers within target fabrics and subsequent treatment through abrasion, sanding, or napping of at least a portion of the target fabric. Such a procedure includes "nicking" the immobilized fibers thereby permitting the fibers to produce a substantially balanced strength of the target fabric in the fill and warp directions while also providing the same degree of hand improvements as obtained with previous methods. Furthermore, this process also provides the unexpected improvement of non-pilling to synthetic fibers as the "nicking" of the immobilized fibers results in the lack of unraveling of fibers and thus the near impossibility of such fibers balling together to form unwanted pills on the fabric surface. Fabrics treated by this process are also contemplated within this invention.

20 Claims, No Drawings

DESIRABLE HAND FABRICS EXHIBITING LOW FILL TENSILE STRENGTH LOSS AFTER PHYSICAL TREATMENTS

CROSS REFERENCE TO RELATED APPLICATIONS

This application is a continuation of application Ser. No. 09/777,444, filed on Feb. 6, 2001, which is a continuation of application 09/569,473, filed on May 12, 2000, now U.S. Pat. No. 6,230,376, which is a continuation of application Ser. No. 09/252,513, filed Feb. 18, 1999 now U.S. Pat. No. 6,112,381. These parent, grandparent, and great-grandparent applications are herein entirely incorporated by reference.

FIELD OF THE INVENTION

The inventive method provides highly desirable hand to various different types of fabrics through the initial immobilization of individual fibers within target fabrics and subsequent treatment through abrasion, sanding, or napping of at least a portion of the target fabric. Such a procedure includes "nicking" the immobilized fibers thereby permitting the fibers to produce a substantially balanced strength of the target fabric in the fill and warp directions while also providing the same degree of hand improvements as obtained with previous methods. Furthermore, this process also provides the unexpected improvement of non-pilling to synthetic fibers as the "nicking" of the immobilized fibers results in the lack of unraveling of fibers and thus the near impossibility of such fibers balling together to form unwanted pills on the fabric surface. Fabrics treated by this process are also contemplated within this invention.

BACKGROUND OF THE PRIOR ART

Materials such as fabrics are characterized by a wide variety of functional and aesthetic characteristics. Of those characteristics, a particularly important feature is fabric surface feel or "hand." The significance of a favorable hand in a fabric is described and explained in U.S. Pat. Nos. 4,918,795 and 4,837,902, both to Dischler, the teachings of which are both entirely incorporated herein by reference.

Favorable hand characteristics of a fabric are usually obtained upon conditioning of prepared textiles (i.e., fabrics which have been de-sized, bleached, mercerized, and dried). Prior methods of prepared-fabric conditioning have included roughening of the finished product with textured rolls or pads. It has now been discovered, surprisingly, that such conditioning would favorably be performed while the target fabric is in its greige state or is unprepared. The conditioning of such fabrics provides heretofore unknown benefits in improvements in overall fabric strength, and the like (as discussed in greater detail below). Of great importance and necessity then within the textile treatment industry is a procedure through which greige or unfinished fabrics can be treated and subsequently finished which provides desirable hand to the target textile and does not adversely impact the ability for dyeing, decorating, and the like, the textile at a future point in time. Such processes have not been taught nor fairly suggested within the pertinent art. Thus, there is no prior teaching nor fair suggestion within the pertinent art which has accorded highly effective and easily duplicated textile hand improvements to greige goods and unfinished textiles.

In the textile industry, it is known to finish woven fabrics by abrading one or both surfaces of the fabric using sandpaper or a similarly abrasive material to cut and raise the fibers of the constituent yarns in the fabric. Through such a treatment, a resultant fabric is obtained generally exhibiting a closely raised nap producing a soft, smooth surface texture resembling suede leather. This operation, commonly referred to as sueding or sanding, is conventionally performed by a specialized fabric sueding machine wherein the fabric is passed under tension over one or more finishing rolls, covered with sandpaper or a similarly abrasive material, which are rotated at a differential speed relative to the moving fabric web. Such machines are described in U.S. Pat. No. 5,752,300 to Dischler, and U.S. Pat. No. 3,973,359 to Spencer, both hereby entirely incorporated by reference.

Another well known technique for enhancing aesthetic and performance characteristics of a fabric through the same type of surface-raising treatment is napping. Such a treatment provides a fabric exhibiting a softer hand, improved drapeability, greater fabric thickness, and better overall durability. Napping machinery generally utilizes rotatably driven cylinders including peripheral wire teeth, such as, normally, card clothing, over which the fabric travels under a certain amount of tension.

During a napping treatment the individual fibers are ideally pulled from the fabric body in contrast to sueding which ideally cuts the individual fibers. Sueding, however, presents some disadvantages including the fact that a certain amount of napping occurs simultaneously. Grit particles engage the surface fibers of the target fabric and inevitably pull them from the fabric body resulting in a relatively long pile. Such a long pile traps air at the surface of the fabric creating an insulating-type effect which thereby produces a warm feeling against the wearer's skin. Such an insulating effect is highly undesirable, particularly for apparel intended for summer wear. Upon utilization of strong synthetic fibers (i.e., nylon or polyester), this tendency for fibers to be pulled from the surface of the fabric is accentuated. More tension would thus be required to cut through such strong fibers (as compared to the force necessary to cut weaker ones) and the stronger fibers then are pulled more easily from the yarn. Upon engagement by an abrasive grit particle, sufficient tension to pull rather than easily cut the fibers is accorded.

Pilling is thus more noticeable with strong synthetic fibers and where a long pile is created (and thus highly disadvantageous) because entanglement between adjacent fibers is more likely to occur, thereby resulting in highly objectionable and unwanted pills on the fabric surface.

Methods have been utilized in the past on prepared fabrics to produce a short pile in order to decrease the potential for pilling. These have included the use of sand paper with very fine grit, brush rolls with grit particles embedded in soft nylon bristles, and even blocks of pumice stone mounted upon oscillating bars. However, the fine grit sandpaper degrades easily and rapidly due to the loss of grit particles and the build-up of debris between the remaining particles. Furthermore, the target fibers are not cut in this fashion as much as they are generally eroded. Thus, fine grit sandpaper does not provide an effective process of replacing the sueding techniques mentioned above. Soft nylon bristles also appear to merely erode the fibers away than cut and also is highly inefficient because of the light pressure such devices apply to the target fabric. Pumice stone, being very soft, is itself subject to damage in such operations and also facilitates unwanted build-up of fibrous debris within the treatment surface of the stone. Undesirable wet procedures are generally necessary to produce any effective sueding results for pumice stone and fine grit sandpaper treatments.

Another disadvantage of prior napping and/or sueding treatments concerns the situation where fill yarns are exposed on the surface of the target fabric. Being perpendicular to the action of the napping and/or sueding, such treatments tend to act primarily upon these exposed yarns rather than the warp yarns. Weaving economy generally dictates that the target fabric would be more heavily constructed in the warp direction and thus it would be highly advantageous for sueding to act primarily on such warp yarns since those yarns exhibit more strength to relinquish during the abrasion procedure.

As noted above, one of the most unpleasant and unsightly phenomena produced through the utilization of strong synthetic fibers within fabrics is pilling. This term is generally accepted to mean the formation of small balls of fiber which are created on the textile surface by the entanglement of free fiber ends. Such fibers which hold the pills to the base fabric do not break off because the synthetic fibers (such as polyester) exhibit a higher flex strength than natural fibers and thus small balls of twisted and entangled fiber cling to the fabric surface.

A number of procedures have been developed to counter this undesirable pilling effect within the textile industry. For instance, polyester fibers have been produced with low molecular weights or low solution viscosities in order to reduce the strength of the fibers resulting in fiber ends and nascent pills which more readily break off from the fabric surface (just as with natural fibers). However, such a reduction in strength (by about 40% from standard polyester fibers) leaves them highly susceptible to damage during further processing thus prohibiting processing on ring or rotor-spinning frames at the same speeds and with the same efficiencies as normal types of natural fibers (such as cotton). A further method to control pilling concerns the chemical weakening of fibers within woven fabrics. This is accomplished through the application of super-heated steam or aqueous solutions of acids, ammonia, ammonia vapors, or amines. In such an instance, however, the entire fabric strength is sacrificed with no concomitant enhancement of hand. Furthermore, the potential for fabric defects (such as stains and uneven dyeing) is increased. An additional method is to utilize yarns having high twist. However, such resultant fabrics exhibit a harsh hand and the internal compression generated by the twist of the individual fibers makes it very difficult to properly de-size, mercerize, and dye fabrics comprising such high-twist yarns. It would thus be highly desirable to obtain substantial reduction in pilling for fabrics comprising strong synthetic fibers without recourse to the above processes and methods. Unfortunately, the prior art has not accorded such an improvement with a simultaneous improvement in hand of the fabric.

The present invention provides a hand improvement method to unfinished fabrics in a manner not disclosed in the known prior art. Such a method also substantially eliminates pilling in fabrics comprised of synthetic fibers simultaneously while providing the aforementioned improvements of the hand of the target fabric.

OBJECTS OF THE INVENTION

The primary object of this invention is therefore to provide improved sueded hand to greige or unprepared fabrics while also retaining a balanced strength over the entire fabric structure. It is thus an additional advantage of this invention to provide such a method that is highly cost-effective and enhances subsequent fabric processing such as de-sizing, mercerization, dyeing, and the like. Another object of this invention to be provide a method of improving the hand of unfinished fabrics comprising synthetic fibers which simultaneously substantially eliminates pilling on the fabric surface. Yet another advantage of this invention is to provide a sueded cotton/polyester blended fabric wherein the sueded surface is dominated by relatively soft polyester fibers. These and other advantages will be in part apparent and in part pointed out below.

DESCRIPTION OF THE INVENTION

In order to improve the hand of fabrics in a manner which is consistent with warm weather wear, the constituent fibers must be treated in a manner which provides a consistently short pile, so that a stagnant layer of insulating air is not trapped at the fabric surface. It has been found that, by first immobilizing the fibers constituting the fabric with a temporary coating, followed by an abrasive treatment of the fabric surface, and then removal of the temporary coating, a fabric of unique aesthetic and practical characteristics is obtained. Compared to a fabric which has been sanded or napped, a fabric treated by the present inventive method is cooler to the touch, smoother to the hand, and dramatically more resistant to pilling. To understand how these advantageous characteristics are obtained, it is useful to compare the action of card wire on a film of polyester (e.g., Mylar™) to the action of the wire on a polyester fabric. When card wire is dragged across a Mylar™ film under pressure, many small scratches are seen to develop in the surface, due to the combination of high pressure at the wire tip combined with the high hardness of the wire relative to polyester. When the wire is similarly dragged across the polyester fabric, scratches are generally not found since the motion of the fibers relative to each other allows the stresses to be dissipated before abrasive wear occurs. Also, the interaction of wire and fiber typically tensions the fiber and draws it away from the yarn surface. When the fabric subsumes the characteristics of a film, scratching of the fiber surface does then occur, and pulling out of fibers from the yarn is prevented. Thus, the fabric is transformed into film (or composite), abraded, and then transformed back into a fabric. What would be linear scratches on a film appear as nicks of various sizes on the surface fibers, including nicks which entirely cut through some of the fibers. The cut fiber ends will be released during subsequent processing (e.g., de-sizing) to form a pile which is uniformly short. Short fibers resist forming pills because the number of adjacent fibers available for entanglement is limited to those few within reach of each other. "Nicks" on these fibers serve as stress risers, allowing the fiber to break off during the kind of bending that occurs during pill formation. Since only the surface fibers have been so weakened, the bulk of the fabric strength has been retained as compared to chemical treatments, which necessarily weaken the entire fabric structure.

The term "nicking" basically encompasses the creation of cuts at random locations on individual fibers thus providing stress risers on the individual fibers. The immobilization of these fibers thus increases frictional contact between the individual fibers and prevents movement of the fibers during the sanding, abrading, or napping procedure. The abrading, sanding, or napping of non-immobilized fibers which move during treatment can result in the relative motion of the fibers and the pulling out of long fibers as the fibers interact with the abrasive or napping media. Such a process does provide improvements in the hand of such fabrics; however, the filling strength of the fabric may be sacrificed and the ability of the fabric to trap unwanted air (thus producing a warmer" fabric) is increased. Therefore, the inventive process comprises first immobilizing the surface fibers of a fabric with a temporary coating; second, treating the immobilized surface fibers by abrasion, sanding, or napping in order to cut and "nick" the fibers; and third, removing, in some manner, the temporary coating.

The immobilization step thus comprises encapsulating at least the surface fibers (and possibly some of the internal fibers of the fabric) in a coating matrix which makes the fibers stationary to the point that the individual fibers are resistant to motion due to the space-filling characteristics of the coating matrix within the interstices between the fibers, as well as the adhesion of adjacent fibers by the coating matrix. A typical coating matrix which imparts immobilization on the surface fibers of a target fabric is size (i.e., starch, polyvinyl alcohol, polyacrylic acid, and the like) which can easily be removed through exposure to water or other type of solvent. Usually, size is added to warp yarns prior to weaving. In accordance with this invention, the size already present in the greige goods to be abraded may be employed for the purpose of immobilization; alternatively, additional size may be coated onto the target fabric to provide a sufficient degree of rigidity.

To be effective (i.e., to impart the proper degree of rigidity or immobilization to the target fibers), the coating does not have to fill the entire free space of the yarn; however, a solids coating level of between 5 and 50% by the weight of the fabric has been found to be particularly effective. A coating range of between 10 and 25% of the weight of the fabric is most preferred. In one particularly preferred embodiment, a greige fabric is to be subsequently treated through sanding, abrading, or napping but does not require any further application of size. As long as the size present during the weaving procedure is not removed thereafter, sufficient rigidity will exist for proper immobilization of the target fabric for further treatment by sanding, abrading, or napping within the inventive process. Another preferred method of immobilization through size application is to dissolve the coating agent in water and pad onto the fabric, followed by a drying step; however, this encompasses both sized (greige) and de-sized fabrics.

Another temporary coating available within the inventive immobilization step is ice. In such an instance, 50 to 200% by weight of water is applied to the target fabric that is subsequently exposed to subfreezing temperatures until frozen. The fabric is then abraded while frozen and then dried. One embodiment of this type of immobilization includes padding on at least about 50% owf and at most about 200% owf water and then freezing the fabric in situ. Such a method may be utilized on greige, prepared, or finished goods and it eliminates the need to add extra amounts of size to an already-woven fabric. This elimination of the need to add and recover size is therefore highly cost-effective. If ice is utilized to immobilize the constituent fibers of the target fabric, napping with metal wires or brushes is the preferable method of treating the target fabric. Wire allows ice, which has melted and refrozen, to break free easily. The resultant ice film could render sanders and/or abraders ineffective since the grit generally utilized in those procedures is very small and would not penetrate through the film to "nick" the individual fibers as is necessary for this inventive process to function properly. The frozen target fabric is preferably maintained at a low temperature (at least from about −10 to about −50° C.), both to insure that the ice has sufficient shear strength for immobilization, and to provide enough heat capacity to absorb the mechanical energy imparted by the abrasion process without melting.

As noted above, the size employed as an aid to weaving may be retained subsequent to weaving, and employed in the present invention to immobilize the target fibers. This is believed to be unique within the textile industry. While such processes as singeing and heat-setting may be applied to greige goods, neither process obtains the advantages from the presence of size on the greige fabric. Otherwise, size is removed from greige goods prior to any further treatment (such as mercerizing, bleaching, dyeing, napping, sanding, and the like).

The most important step to the inventive method is the immobilization of the surface fibers. Thus, abrading, sanding, napping, and the like, may be utilized within the inventive process. Thus, abrading through contacting a fabric surface with an abrasive-coated cylindrical drum rotating a speed different from that of the fabric web is one preferred embodiment within this inventive process. Such a method is more fully described in U.S. Pat. Nos. 5,752,300 and 5,815,896, both to Dischler, herein entirely incorporated by reference. Angular sueding, as in U.S. patent application Ser. No. 09/045,094 to Dischler, also herein entirely incorporated by reference, is also an available method. The preferred abrasive is diamond grit embedded in an electroplated metal matrix that preferably comprises nickel or chromium, such as taught within U.S. Pat. No. 4,608,128 to Farmer. Other hard abrasive particles may also be used such as carbides, borides, and nitrides of metals and/or silicon, and hard compounds comprising carbon and nitrogen. Electroless plating methods may also be utilized to embed diamond and other hard abrasive grit particles within a suitable matrix. Preferably, the diamond grit particles are embedded within the plated metal surface of a treatment roll with which the target fabric may be brought into contact so that there is motion of the fabric relative to the grit particles. Since both the diamond facets and the metal matrix are microscopically smooth, build-up of size coating on the abrasive treatment surface is generally easily avoided. However, as noted previously, a more severe problem occurs where ice is utilized as the immobilizing matrix. The pressure of the fabric in contact with the small abrasive grit particles may cause the ice to melt and instantly refreeze onto the abrasive-coated cylinder. Also, since ice is generally weaker than polymeric sizing agents, a greater weight add-on is required to provide sufficient rigidity to the individual fibers. A thicker layer of coating thus results on the surface, and this superficial ice thickness interferes with the contact of the grit particles with the target fibers. As such, the grit particles would not be sufficient to "nick" the surface fibers. In such an instance, a napping procedure is preferred which utilizes wire brushes to condition the fabric surface, as taught in U.S. Pat. No. 4,463,483 to Holm. A cylindrical drum may still be utilized in such a situation with a napping wire wrapped around the drum which is then brought into contact with the target fabric, again a speed different from that of the fabric web. Normally, napping in this manner pulls the surface fibers away from the fabric surface; in the inventive method, the fibers are held in place and the desirable and necessary "nicking" of the individual fibers is thus accomplished. The bending of the wire during contact with the fabric allows ice to continually break free while the length of the wire insures that the ice coating can be penetrated and the "nicking" procedure is, again, accomplished.

The particular types of fabrics which may be subjected to the inventive method are myriad. Such include, without limitation, any synthetic and/or natural fibers, including synthetic fibers selected from the group consisting of polyester, polyamide, polyaramid, rayon, lycra, and blends thereof, and natural fibers are selected from the group consisting of cotton, wool, flax, silk, ramie, and any blends thereof. The fabrics may also be constructed as woven, non-woven, and/or knit materials. Preferably, the target fabric comprises synthetic fibers and is woven. More preferably, the fabric comprises woven polyester fibers in spun yarns.

It has been determined that warp-faced twill fabrics are particularly suited to this inventive process because all of the exposed surface yarns of the woven substrate are sized which thus results in immobilization of all of the desired fibers thereby facilitating the "nicking" procedure described above. Furthermore, the costs associated with padding on size, drying, and de-sizing may also be avoided in some cases by abrading the fabric in the greige state. Usually, the warp yarns are sized prior to weaving in order to protect them from damage while fill yarns are generally untreated. If the fabric is warp-faced (e.g., a warp-faced twill fabric), then the abrasion step may be directly performed on the face, without any added processing steps required. Surprisingly, this approach has been found to be successful with plain woven fabrics, even though the fill yarns are not sized. In these fabrics, directly from the loom, the fill is comparatively straight and therefore is buried in the fabric structure (and thus much less accessible to the abrasive treatment). Generally, fabric that has been so treated is then processed in the normal manner, which typically combines steps such as de-sizing, mercerizing, bleaching, dyeing, and finishing. In special cases, the fabric may be sold to converters directly after the abrasion process. The converter would then do all or part of the subsequent processing. In cases where the size has functionality, it can be left on the fabric and can become part of the final product. For instance, in the case of abrasive-coated cloth (i.e., where it is desired to bond abrasive grit particles to the cloth) the size acts as a primer coat keeping the resin at the surface and physically preventing it from penetrating the body of the cloth in an uncontrolled fashion.

Also of particular interest within this invention is the fact that sueding of cotton/synthetic fiber blend fabrics in the greige state, prior to mercerization, is now known to produce unexpectedly beneficial effects. Historically, synthetic fibers for use in apparel, including polyester fibers, have generally been supplied to the textile industry with the object of duplicating or improving upon the characteristics of natural fibers. Such synthetic textile filaments were mostly of deniers per filament (dpf) in a range similar to those of the standard natural fibers (i.e., cotton and wool). More recently, however, polyester filaments have been available on a commercial level in a range of dpf similar to natural silk (i.e., of the order of 1 dpf), and even in subdeniers (below 1 dpf). Such fibers and considerably finer and more flexible than typical cotton fibers and thus are potentially preferred in the industry over such natural fibers. It has thus been discovered that fabrics containing cotton blended with such low dpf polyester fibers treated in accordance with this inventive method, then subsequently mercerized, exhibit a sueded surface that is substantially dominated by the synthetic fibers. This effect occurs because the cotton portion of the generated pile tends to kink, bend, and shorten due to the swelling effect of the caustic on the cut cotton fibers. These fibers tend to swell to the greatest possible degree since they are not tensioned. Kinking and bending is further accentuated by the presence of "nicks" on these fibers, resulting in localized swelling where the cuticle of the cotton fiber is breached. The same effect does not occur with the cut polyester or other synthetic fibers that do not swell in the presence of caustic, so that the synthetic fibers ultimately dominate the surface aesthetics. This is advantageous when the target fabric contains synthetic fibers that are more flexible than mercerized cotton fibers, usually in the range of 1.5 dpf or less for polyester fibers. Such a benefit has not been readily available to the industry until now.

DETAILED DESCRIPTION AND PREFERRED EMBODIMENTS OF THE INVENTION

The above as well as other objects of the invention will become more apparent from the following detailed examples representing the preferred embodiments of the invention.

EXAMPLE 1

Four samples of 7.5 ounce per linear yard (66 inches wide) warp-faced twill fabric comprised of an intimate blend of 65% polyester and 35% cotton and completely constructed of open-end spun yarns were treated. One was a prepared fabric (i.e., already de-sized, bleached, mercerized, and dried) subjected to sanding alone and the other three were of the same fabric style prior to preparation. The combined level of abrasion for the front and back of all four test fabrics was the same, with varying proportions of such individual front and back sanding performed. The four samples, along with an untreated control, were then dyed, finished, and ultimately subjected to 10 industrial washes prior to testing.

The sanding operation was performed through contact with two pairs of 4.5" diameter rolls equipped with 320 U.S. grit diamonds in an electroplated nickel matrix. Each side of the fabric was treated by one pair of rolls (unless noted below to the contrary). The first roll for each side rotated against the direction of fabric travel and the second rotated with the fabric travel direction. The fabric subjected to the inventive procedure was a greige fabric, the fibers of which were already sufficiently immobilized through the presence of the size (polyvinyl alcohol) applied to the constituent warp yarns prior to weaving.

Strength performance was analyzed through measurements of the tensile strength of the fabrics in different directions. The tensile strengths (pounds per inch to break) were measured in both the warp and fill directions. The warp/fill ratio, as used below, is the ratio of the warp to fill tensile strengths. For a fabric with balanced overall tensile strength, this ratio would be 1.0. Abrading a fabric so that the warp/fill ratio is close to 1.0 is the ideal, as it results in an isotropic material with no weak direction, and makes the most efficient use of the starting tensile strengths of the fabric. Pilling performance was measured through an empirical analysis and rating system. Such ratings ran from 1 (worst) to 5 (best), with such lower numbers indicating a high degree of undesirable pilling on the surface and a higher number denoting the lack of appreciable amounts of pills on the test fabric surface.

The five samples were tested (3 subjected to the inventive procedure, one as a sanded control, and the remaining sample unsanded). Run #1 involved the greige fabric with retained size treated through a sanding procedure which constituted equal abrasion between the face and the back of the target fabric (50% face/50% back). Run #2 was also subjected to the inventive process and constituted a 60% face/40% back sanding procedure. Run #3 involved a 100% face sanding procedure within the inventive process. Run #4 treated a control sample by a 50%/50% sanding procedure, and Run #5 was a control sample which was not treated by sanding at all (and thus exhibited a harsh hand and other undesirable characteristics for apparel uses). The results of these analyses are provided below in tabulated form:

TABLE

| Run | Warp Tensile | Fill Tensile | Warp/Fill | Pilling Rating |
|---|---|---|---|---|
| | Fabric Strength | | | |
| 1 | 148 | 115 | 1.29 | 4.5 |
| 2 | 135 | 130 | 1.04 | 4.5 |
| 3 | 148 | 139 | 1.06 | 4.5 |
| 4(Control) | 146 | 93 | 1.57 | 4.0 |
| 5(Control) | 176 | 138 | 1.28 | 4.0 |

Clearly, the prepared (control) fabrics exhibit unbalanced tensile properties with the warp about 28% stronger than the fill. Sanding both sides of these fabrics increases this imbalance to 57%, while the fabrics subjected to the inventive processes exhibited an average reduction in fabric direction strength imbalances. Since the strength of the fabric as a whole is governed by the fabrics' weakest direction, the greatest sueding efficiency is realized when the warp and the fill have similar final strengths as was achieved and best evidenced through following the inventive process.

EXAMPLE 2

Two samples, one subjected to the inventive process and the other a control, of 4.8 ounces per square yard warp-faced twill comprised of an intimate blend of 65% polyester/35% cotton open-end spun yarns were treated in the same manner as in Run #s 1 and 5 of EXAMPLE 1, above. After 10 industrial washes, the control fabric exhibited a pilling rating of 2.0 while the fabric subjected to the inventive process showed a pilling rating of 4.0.

EXAMPLE 3

Two samples, one subjected to the inventive process and the other a control, of 5.2 ounces per square yard plain woven fabric comprised of open-end spun polyester yarns were treated in accordance with Run #s 1 and 5 of EXAMPLE 1, above, with the following variation. As both samples were prepared fabrics (i.e., they did not contain size), a solution of 15% PVA size was dissolved in water and padded on to the inventive process fabric for a wet pick-up of 100%. After drying at 135° C. for 15 minutes, this fabric was then sanded on both sides (50% face/50% back). Both samples were then washed and heat-set. The samples treated in accordance with the inventive process was found to exhibit about a 5.0 pill rating. The heat-set control sample, to the contrary, exhibited a very high degree of pilling for a 1.0 rating.

EXAMPLE 4

The same type of plain woven fabric as in EXAMPLE 3 was wet out with water so that the weight of the fabric approximately doubled. The wet fabric was then placed on a stainless steel cold plate for which the temperature was maintained between about −20 and −50° C. through contact with dry ice directly below the plate. Upon complete freezing of the water, the fabric face was scrubbed in the warp direction with straight carding wire. After this abrasion procedure, the fabric was dried to remove all moisture. A very short and even pile was developed which exhibited substantially no pilling for a rating of 5.0.

EXAMPLE 5

Again, the same type of plain woven fabric as in EXAMPLE 3 was utilized but this time a continuous web of the fabric was wet out and passed into a bath of liquid nitrogen. The face of the frozen fabric was then abraded by contact with rotating rolls having axes oriented in the fill direction of the fabric web and wrapped with straight carding wire. The first roll turned in the direction opposite of fabric travel and the second turned with the fabric travel direction. Upon heating and drying, the fabric exhibited a very short and even pile and was found to have substantially no pills for a rating of 5.0. An untreated plain woven fabric control fabric, on the other hand, exhibited a high degree of pilling for a rating of 1.0.

It is not intended that the scope of the invention be limited to the specific embodiments described herein, rather, it is intended that the scope of the invention be defined by the appended claims and their equivalents.

What is claimed is:

1. A woven fabric having a top surface and a bottom surface, said fabric comprising fill and warp yarns selected from the group consisting of polyester, cotton, and blends thereof; wherein said fill yarns collectively exhibit a fill tensile strength within said fabric; wherein both said fill and warp yarns of at least one of said top and bottom surface are treated by a process selected from the group consisting of sueding, sanding, and abrading while said yarns are immobilized in order to impart nicked appearances within the surface fibers within said at least one treated surface of said fabric; wherein said at least one treated surface of said fabric exhibits a softer hand than a non-treated surface of the same woven fabric; wherein said fill tensile strength of said woven, treated fabric is measured to be an amount of at least 80% of the fill tensile strength of the same fabric measured prior to treatment.

2. The woven fabric of claim 1 wherein said fill tensile strength of said woven, treated fabric is measured to be an amount of at least 85% of the fill tensile strength of the same fabric measured prior to treatment.

3. The woven fabric of claim 2 wherein said fill tensile strength of said woven, treated fabric is measured to be an amount of at least 90% of the fill tensile strength of the same fabric measured prior to treatment.

4.The woven fabric of claim 3 wherein said fill tensile strength of said woven, treated fabric is measured to be an amount of at least 93% of the fill tensile strength of the same fabric measured prior to treatment.

5. The woven fabric of claim 1 wherein said fill and warp yarns are comprised of a blend of polyester and cotton fibers.

6. The woven fabric of claim 5 wherein said blend of fibers is about 65% polyester and 35% cotton.

7. The woven fabric of claim 6 wherein said woven fabric is warp-faced.

8. The woven fabric of claim 7 wherein said warp-faced woven fabric is a twill.

9. The woven fabric of claim 2 wherein said fill and warp yarns are comprised of a blend of polyester and cotton fibers.

10. The woven fabric of claim 9 wherein said blend of fibers is about 65% polyester and 35% cotton.

11. The woven fabric of claim 10 wherein said woven fabric is warp-faced.

12. The woven fabric of claim 11 wherein said warp-faced woven fabric is a twill.

13. The woven fabric of claim 3 wherein said fill and warp yarns are comprised of a blend of polyester and cotton fibers.

14. The woven fabric of claim 13 wherein said blend of fibers is about 65% polyester and 35% cotton.

15. The woven fabric of claim 14 wherein said woven fabric is warp-faced.

16. The woven fabric of claim 15 wherein said warp-faced woven fabric is a twill.

17. The woven fabric of claim 4 wherein said fill and warp yarns are comprised of a blend of polyester and cotton fibers.

18. The woven fabric of claim 17 wherein said blend of fibers is about 65% polyester and 35% cotton.

19. The woven fabric of claim 18 wherein said woven fabric is warp-faced.

20. The woven fabric of claim 19 wherein said warp-faced woven fabric is a twill.

* * * * *